US005630578A

United States Patent [19]

Naramore et al.

[11] Patent Number: 5,630,578

[45] Date of Patent: May 20, 1997

[54] LOW MANUAL EFFORT SYSTEM FOR REMOVABLY MOUNTING PAPER HANDLING MODULES TO REPRODUCTION MACHINES

[75] Inventors: Raymond A. Naramore, Webster; Steve S. Counoupas, Rochester, both of N.Y.

[73] Assignee: Xerox Corporation, Stamford, Conn.

[21] Appl. No.: 618,045

[22] Filed: Mar. 25, 1996

[51] Int. Cl.[6] ..... B65H 39/02

[52] U.S. Cl. ..... 270/58.08; 271/287; 271/298; 312/198

[58] Field of Search ..... 270/58.08; 399/403; 271/287, 288, 298; 312/201, 198

[56] References Cited

U.S. PATENT DOCUMENTS

| | | | |
|---|---|---|---|
| 4,299,382 | 11/1981 | Ichikawa | 271/287 |
| 4,433,881 | 2/1984 | Witten et al. | 312/198 |
| 4,844,566 | 7/1989 | Moore et al. | 312/198 |
| 5,011,130 | 4/1991 | Naito et al. | 271/288 |
| 5,144,369 | 9/1992 | Benedict et al. | 355/245 |
| 5,279,217 | 1/1994 | Ueda et al. | 271/288 |
| 5,320,336 | 6/1994 | Asami | 270/58.08 |
| 5,326,093 | 7/1994 | Sollitt | 271/306 |
| 5,409,202 | 4/1995 | Naramore et al. | 270/53 |
| 5,434,661 | 7/1995 | Takahashi et al. | 270/58.08 |

*Primary Examiner*—John T. Kwon

[57] ABSTRACT

A system and method for manually removably locking a paper handling module to a reproduction apparatus with greatly reduced manual force, wherein the reproduction apparatus and the paper handling module have respective sheet feed openings which are operatively aligned for sheet feeding therebetween when the module is so locked to the reproduction apparatus in a locking position, and wherein the paper handling module has a weight which is undesirable for manual lifting into the locking position. The module is supported on an integral module transporting system to be freely movable in any horizontal direction into an initial docking position closely adjacent to the reproduction apparatus. Then, slightly vertically lifting at least one side of the module with only a small vertical manual lifting force while most of the weight of the module is lifted with an automatic weight lifting system, moving the module towards the locking position, and then removing the small vertical manual lifting force from the module, to drop and lock the module to the reproduction apparatus. The automatic weight lifting may be provided by vertically movably spring loading at least one side of the module on the module transporting system.

17 Claims, 7 Drawing Sheets

LOW MANUAL EFFORT SYSTEM FOR REMOVABLY MOUNTING PAPER HANDLING MODULES TO REPRODUCTION MACHINES

Reproduction apparatus, such as xerographic or other printers, copiers, and/or multi-function devices, commonly have modular paper handling accessory units which need to be removably connected to the reproduction apparatus in a secure manner which provides operative connections therewith. In particular, to provide the sheet feed opening of the removable module operatively aligned with the appropriate sheet feed opening of the reproduction apparatus, so that copy or document sheets may be fed therebetween. Yet, many such modules can be quite heavy, especially sheet finishing units and/or sorters or stackers.

Disclosed in the embodiments herein is an improved system for such operative connection between a reproduction apparatus and one or more such paper handling accessory modules, with improved locking and unlocking therebetween with substantially reduced manual force or effort.

The disclosed system does not require previously used mounting rails and/or installer hydraulic or pneumatic lifters or pallets to support and lift the weight of the module as it is being docked with and secured to the reproduction apparatus. That is, it is desirable to reduce or eliminate the amount of lifting and carrying equipment required for installing accessory modules on reproduction apparatus. It also overcomes problems where the reproduction apparatus and/or the module are on uneven floor surfaces, common in customer sites, such as where the module or the reproduction apparatus are on carpeted versus uncarpeted areas, or the like.

Modules allow adding on additional customer features to previously installed printers or copiers, and allow offering different reproduction systems customer options for the same basic printer or copier. The use of removable and/or substitutable paper handling module units provides greater flexibility in customer options of paper feeders and/or paper output finishing and/or stacking systems such as sheet folders, stitchers, staplers, book binders, etc. Other auxiliary modules which are known to be desirable add-on features include high-capacity alternate sheet feeders for the input of additional and/or alternate size copy sheets to the reproduction apparatus. Furthermore, the use of removable modules allows the basic reproduction apparatus itself to be smaller and lighter, with a smaller floor size or footprint, and thus easier to move and install. Ideally, the modules themselves should be easily installable and removable by the tech rep and/or installer, or even the operator or customer.

As indicated, such modules can be heavy. Yet, it is desirable not to require a large manual effort for module installation, or any force which cannot be easily and safely done by ordinary men and women, not just strong professional riggers or movers. Yet, as indicated above, it is also important that any such paper handling module be properly vertically and horizontally aligned in a proper mounting and locking position with respect to the reproduction apparatus, so that the existing sheet input or output path openings and baffles of the reproduction apparatus are properly aligned with the sheet openings and baffles of the module for the uninterrupted and jam free feeding of the flimsy paper or other such reproduction sheets therebetween. This mating position of the two units must be maintained, and must be reestablished every time the two units are separated and then redocked and reconnected.

Another important desirable feature is to allow the paper handling module unit and the reproduction apparatus to be easily connected and disconnected even in the limited space or cramped quarters of many office and other copying areas. Many of the present paper handling accessory module units for reproduction apparatus require substantial lateral free space between the end of the reproduction apparatus and a wall or other obstruction because the module can only be separated from the reproduction apparatus by moving in one direction on rails or tracks extending away from that end of the reproduction apparatus. Thus, it is desirable to allow a module to be initially moved toward the reproduction apparatus and docked therewith from either the front or side of the reproduction apparatus, and to be separated and removed from the reproduction apparatus in either direction as well. This allows the overall dimensions of the combined reproduction apparatus and module to be installable in spaces only slightly greater in dimension that the total dimensions of both. The disclosed system does not have said disadvantages of requiring a mounting track or rail system restricting separation movement to the direction away from the end of the reproduction apparatus, and does not require a large movement distance for mounting or removal.

Another advantage of the disclosed embodiments is that a desirably small floor space module too narrow to be safely stable as an unsecured free-standing module may be utilized, by being safely secured to a large reproduction apparatus, for insuring lateral or tipping stability. The present system can provide this without applying a large cantilever, bending or tipping force to the reproduction apparatus or its frames.

Although one example of a sheet handling output module for stacking and/or finishing sets or jobs of copy output sheets is illustrated herein, it will be appreciated that the present system of interconnection of sheet handling modules to reproduction apparatus is widely applicable to a wide variety of different sheet handling modules with the same basic advantages of greatly reduced installation manual effort, etc. Specifically, with the advantage that the installing person need never lift more than a small percentage of the total weight of the paper handling module accessory, even when, due to unevenness of the floor, the module and reproduction apparatus are initially at different and/or uneven levels. E.g., such as where the processor is on a carpeted area but the add-on module unit will not be, or vice versa, Furthermore, because the subject mounting system provides correct alignment of the respective sheet input and output paths of the module and reproduction apparatus, there is no requirement for an interface transport or module transitioning the paper path between the reproduction apparatus and the output device, for example that shown in Xerox Corporation U.S. Pat. No. 5,326,093 issued Jul. 6, 1994 to Thomas E. Sollitt.

The particular illustrated disk type invader stacker and stapler finisher unit per se shown in the exemplary module embodiments herein is similar to that disclosed in more detail in Xerox Corporation U.S. Pat. No. 5,409,202 issued Apr. 25, 1995 to the same Raymond A. Naramore, et al and thus need not be described herein in any detail.

Of particular interest for module movements, interchangeable color toner developer unit transport cads for printers with uneven floor alignment compensation are shown in Xerox Corporation U.S. Pat. No. 5,144,369 issued Sep. 1, 1992 to Lawrence R. Benedict, et al. However, as may be seen, that patent has a much more complicated foot pedal lifting system for leveling the developer unit with machine rails on which the developer unit is slid into the machine, or out of the machine. This is not a paper handling accessory module mounting system and is self-evidently considerably more complex than the disclosed system.

The disclosed embodiments provide the securing advantages of a simple "hang on" connection module without the usual disadvantages of putting a cantilevered load of the entire weight of the module on the frames of the reproduction apparatus. Furthermore, because only a small portion of the weight of the module is carried by the reproduction apparatus, the "hang on" mounting and/or locking system may comprise a simple mounting hook system such as disclosed hereinbelow, and the module can even latch with relatively thin or lightweight frame or cover members of the reproduction apparatus and/or the module. Also, the present system does not require any person to support the weight of the module, even as the module is being "hung on" to the side of the reproduction apparatus. Also, the module may be rolled about easily in any direction, even on uneven floors, without having to carry or lift the module.

In fact, as shown in these embodiments, the mounting modification of the printing apparatus may consist of something as simple as mounting slots or apertures in the existing sheet metal or plastic side or end wall of the reproduction apparatus, and simple correspondingly spaced hooks of appropriate configuration on the module unit which are easily and intuitively mounted through said apertures while the weight of the module is substantially automatically supported and/or lifted by the system disclosed herein.

It may be seen that a low cost, simple, and universal or widely useable docking and mounting system for various add-on modules for reproduction apparatus is disclosed herein.

A specific feature of the specific embodiment disclosed herein is to provide, in a reproduction system for generating printed sheets with a reproduction apparatus and providing for docking and operatively connecting and disconnecting one or more selected paper handling modules of substantial weight to said reproduction apparatus, wherein said reproduction apparatus and said paper handling module have respective sheet feed openings, which respective sheet feed openings are operatively aligned for sheet feeding therebetween when a said selected paper handling module is operatively connected to said reproduction apparatus; a system for said docking and removably operatively connecting and disconnecting a selected said paper handling module accessory unit to said reproduction apparatus with greatly reduced manual movement force irrespective of the weight of said module, including a locking system positively securing said module to said reproduction apparatus in a locking position with said sheet feed opening of said module sufficiently operatively vertically aligned with said sheet feed opening of said reproduction apparatus for sheet feeding opening of said reproduction apparatus for sheet feeding therebetween, wherein said paper handling module accessory unit has a transporting system allowing said module to be freely manually movable in any horizontal direction for both frontal and lateral horizontal movement relative to said reproduction apparatus into a docking position therewith while supporting the weight of said module, and said paper handling module accessory unit has a low-force vertical docking position adjustment system providing for low force manual vertical movement of said module relative to said reproduction apparatus from said docking position into said locking position, after said module is initially horizontally docked with said reproduction apparatus, and said vertical docking position adjustment system includes a weight supporting system for automatically supporting a major portion of the weight of said module in said manual vertical movement of said module into said locking position, for said greatly reduced manual movement force.

Further specific features disclosed herein, individually or in combination, include those wherein said vertical docking position adjustment system and its said weight supporting system comprises a spring loaded vertically movable separation system between said module transporting system and said module; and/or wherein said module transporting system comprises plural castored wheels mounted under said module, and wherein said vertical docking position adjustment system and its said weight supporting system comprises a vertically movable wheel mounting system with module weight supporting springs vertically acting to provide low force vertical movement of said module relative to said castored wheels; and/or wherein said locking system for securing said module to said reproduction apparatus in said locking position is latched by first vertically lifting said module slightly above said initial docking position, with said weight lifting system and a small added manual vertical force, and moving said module against said reproduction apparatus, and then releasing said small manual vertical force to allow said module to drop into said locking position and latch.; and/or wherein said locking system for securing said module to said reproduction apparatus in said locking position comprises mounting hooks and hook retainers positioned so that when said module is vertically lifted slightly above said initial docking and said locking position said mounting hooks may be inserted into said hook retainers, and so that said mounting hooks latch said module to said reproduction apparatus on said hook retainers by automatic downward movement of said module when said module is released; and/or wherein said weight supporting system automatically lifts all but a minor portion of the weight of said module in said vertical movement of said module into said locking position; and/or wherein said paper handling module is a finishing unit for binding and stacking sets of printed sheets from said reproduction apparatus; and/or wherein said module transporting system comprises plural castored wheels mounted under said module, and wherein said vertical docking position adjustment system weight supporting system provides low force vertical movement of said module relative to said castored wheels with module weight supporting springs which are spring mounting at least one side of said module relative to said castored wheels; and/or wherein a removable spring locking system normally removably locks said module weight supporting springs; and/or an improved method for manually removably locking a paper handling module to a reproduction apparatus in a locking position, wherein said reproduction apparatus and said paper handling module have respective sheet feed openings, which respective sheet feed openings are operatively aligned for sheet feeding therebetween when said module is so locked to said reproduction apparatus in said locking position, and wherein said paper handling module has a weight which is undesirable for manual lifting into said locking position; comprising an improved system for said locking of said module to said reproduction apparatus with greatly reduced manual force, by, supporting said module on an integral module transporting system on which said module is freely movable in any horizontal direction relative to said reproduction apparatus, moving said module on said module transporting system into an initial docking position closely adjacent to said reproduction apparatus while supporting the weight of said module on said transporting system, then slightly vertically lifting at least one side of said module with only a small vertical manual lifting force applied to said module while most of the weight of said module is lifted with an automatic weight lifting system; moving said module towards said locking position with said reproduction apparatus while so lifting said module, and then removing said small vertical manual lifting force from said module, to lock said module to said reproduction apparatus with said respective sheet feed openings operatively aligned for sheet feeding therebetween; and/or wherein said automatic weight lifting is provided by vertically spring loading at least one side of said module on said module transporting system with a spring loading system that supports all but a minor portion of the weight of said module throughout said slight vertical lifting of said module with said small vertical manual lifting force; and/or wherein said module automatically drops slightly into said locking position when said small vertical manual lifting force is removed, to automatically latch said module to said reproduction apparatus; and/or wherein said module is hooked onto said reproduction apparatus in said locking position by hooking mounting hooks on said module onto hook retainers in said reproduction apparatus; and/or wherein said module is so movable on plural castored wheels mounted under said module providing said module transporting system; and/or wherein said module is unlocked from said reproduction apparatus with only a small manual force much less than said weight of said module by reversing the above steps; and/or wherein said module is initially tilted away from said reproduction apparatus on said module transporting system in said initial docking position and moved towards said reproduction apparatus before said step of slightly vertically lifting said module; and/or wherein a pair of lower hooks on said module are engaged in lower hook retainers on said reproduction apparatus in said initial tilting step, and then a pair of upper hooks on said reproduction apparatus are engaged in upper hook retainers in a second tilting step in coordination with said slight vertical lifting step.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the examples below, and the claims. Thus, the present invention will be better understood from this description of specific embodiments, including the drawing figures (approximately to scale) wherein:

Describing now in further detail the exemplary embodiments with reference to the Figures, there is schematically shown a reproduction machine 10, by way of one example of a printer or copier with physical sheet input and output, for which paper handling modules such as 20 may be readily operatively connected, disconnected and/or interchanged in accordance with the present system, with little manual effort.

Figure 1:
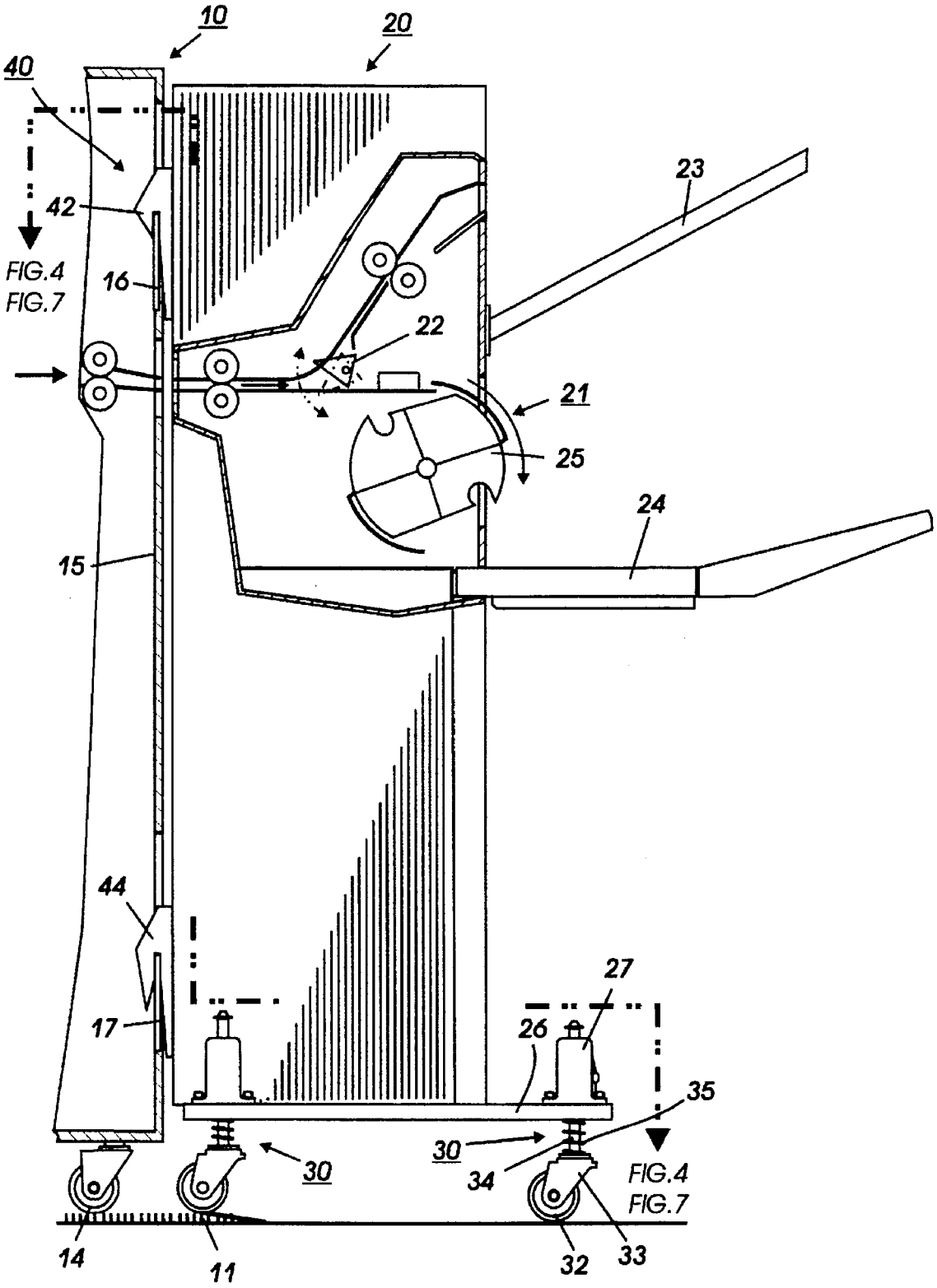
FIG. 1 is a schematic frontal view of one embodiment of the disclosed system, showing one example of a paper handling module and its mounting system mounting it to a reproduction apparatus, only the relevant mounting end portion of which reproduction apparatus is schematically illustrated here.
Figure 6:
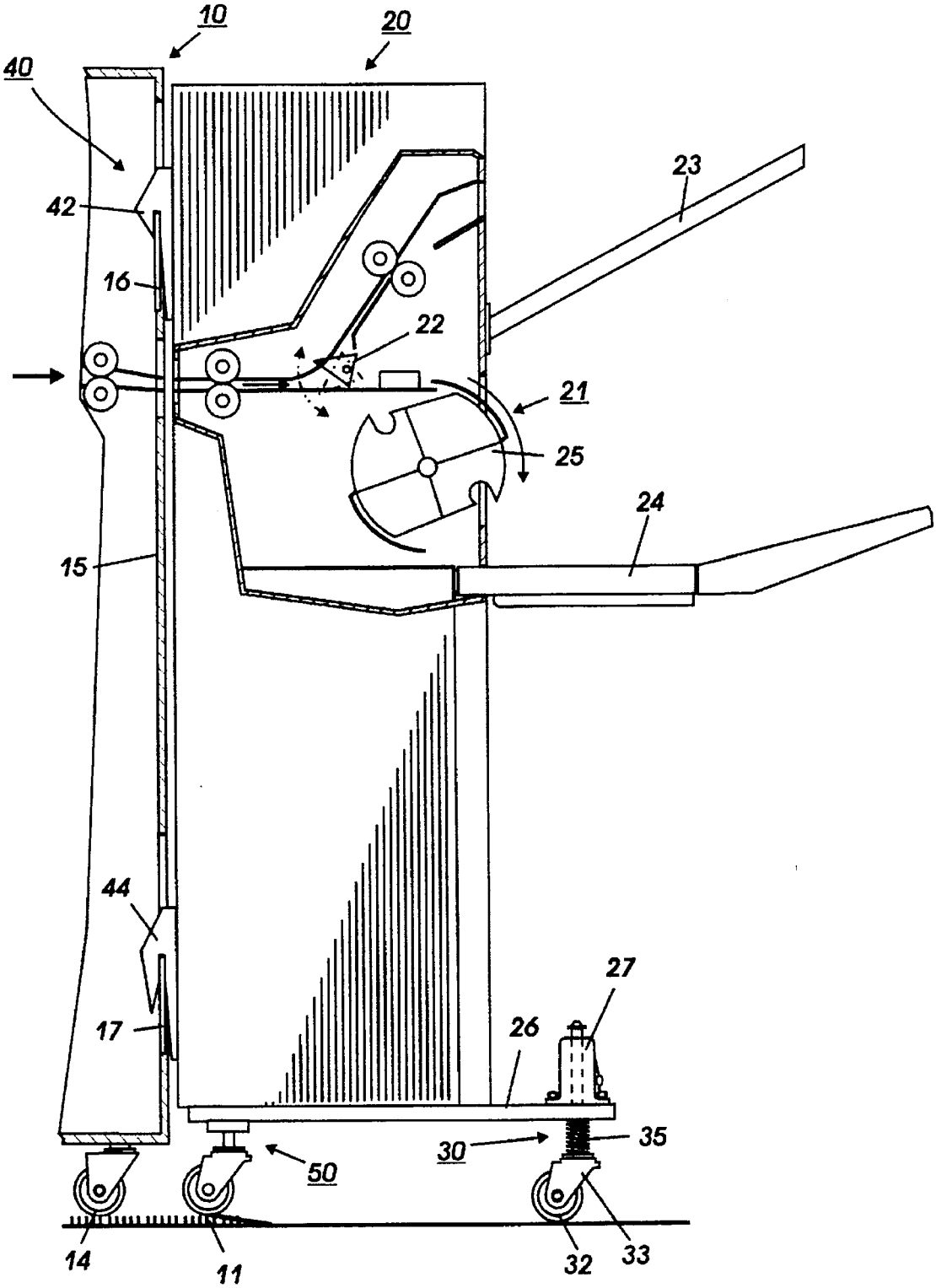
FIG. 6 is substantially identical to FIG. 1 but illustrates an alternative embodiment of which the inside supporting wheels adjacent the reproduction apparatus are fixed rather than spring loaded.

Shown in the Figures is the right-hand side or end of the exemplary reproduction apparatus 10 with a sheet output path therefrom indicated by the arrow and output rollers and baffles through which printed sheets exit the reproduction apparatus 10 through an end wall 15. Both the reproduction apparatus 10 and the module 20 are mounted on a conventional floor or other such support surface 11, which, as shown here, is uneven. This floor 11 unevenness is illustrated in FIGS. 1 and 6 by carpeting shown underlying the mounting wheels 14 of the reproduction apparatus 10 and an uncarpeted area under most of the module 20, merely for purposes of illustrating one of the advantages of the present system.

Figure 9:
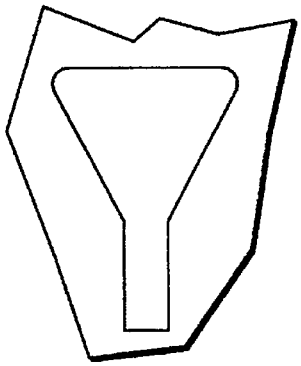
FIG. 9 is an enlarged end view of a portion of the reproduction apparatus showing an exemplary shape of one of the retaining slots for a mounting hook on the module by which the module is latched to the reproduction apparatus in this example.

As will be further described herein, the end wall 15 of the reproduction apparatus 10 has a pair of upper mounting apertures 16 and a pair of lower mounting apertures 17. FIG. 9 shows one example in end view thereof. It may be seen that the upper portion of the apertures 16 or 17 may be enlarged like a keyhole, as shown in FIG. 9, for ease of initial docking and mounting of the module 20 thereto, with the sides of this enlarged upper portion smoothly tapering downwardly to the actual locking slots. These slots may be slightly wider on one side than the other, e.g., 3.5 mm wide on one side versus 7.5 mm wide on the other side, as between the respective pairs 16 and 17 of such mounting aperture slots. This also aids in initial alignment for locking.

Turning now to the exemplary module 20, as indicated this is merely one example of numerous possible input or output sheet handling accessory units which may employ the docking and locking system disclosed herein. This particular module 20 example includes a sheet output stacking system 21, here comprising a sheet input path selector gate 22 which can direct incoming sheets either to an upper stacking tray 23 or to a lower stacking tray 24 via a disk inverter/stacker 25 (of a known type, as indicated above with reference to a previous patent thereon). As disclosed therein, this inverter/stacker 25 may include an integral set stapler and offset system for stapling and offsetting output sets of print jobs. However, the module 20 is not limited to any particular sheet handling, finishing or output system.

Figure 7:
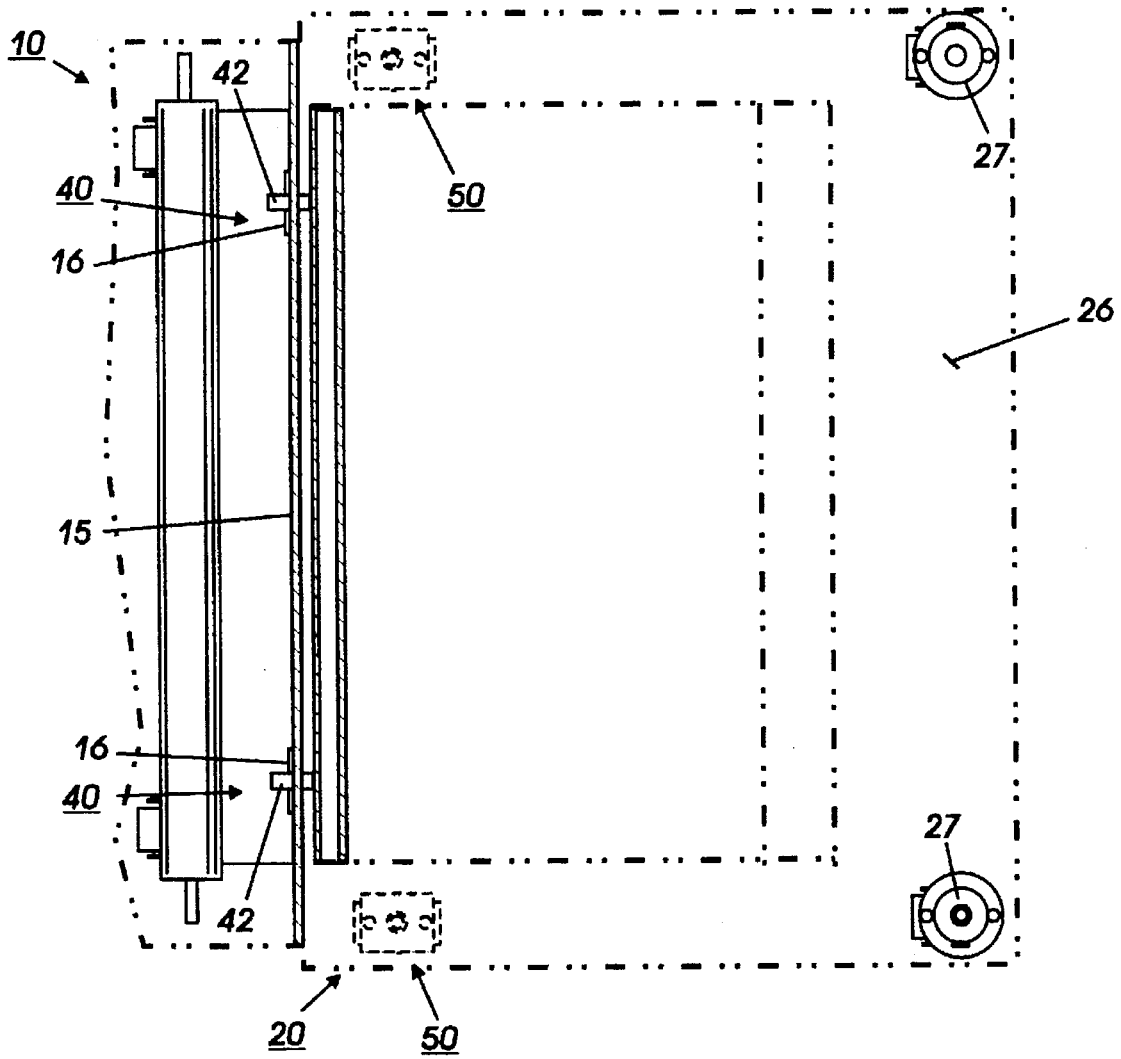
FIG. 7 is a view similar to FIG. 4 of the embodiment of FIG. 6.

Turning now to the transporting, docking, and mounting system of the module 20, the module 20 has a mounting base 26 and mounting cups 27 secured thereto. In the embodiment of FIG. 1–5, all four mounting cups 27 have vertical movement spring castor units 30, as will be described. However, in the embodiment of FIGS. 6–8, the two inboard mounting cups 27 or other such mounting arrangements have alternative unsprung module castor units 50 which rigidly mount these castor wheels to the mounting base 26 without providing for relative vertical movement. However, even with this alternative 50 example, the outboard mounting of the module 20 (at the side opposite from the reproduction apparatus 10) comprises a pair of the sprung castor units 30.

Figure 2:
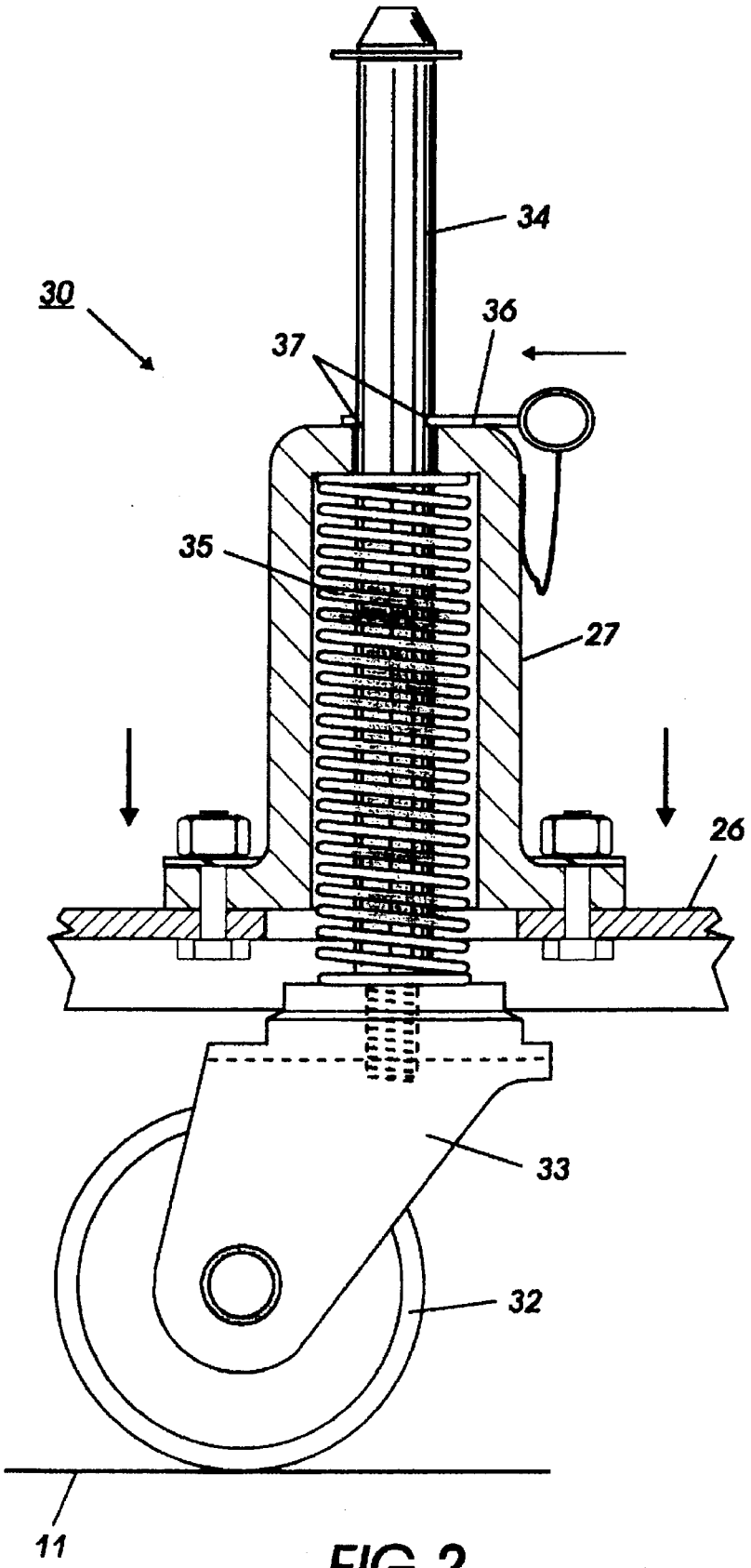
FIG. 2 is an enlarged view of a portion of the module mounting and transporting system, showing the spring loading thereof in its locked or inoperative position.
Figure 3:
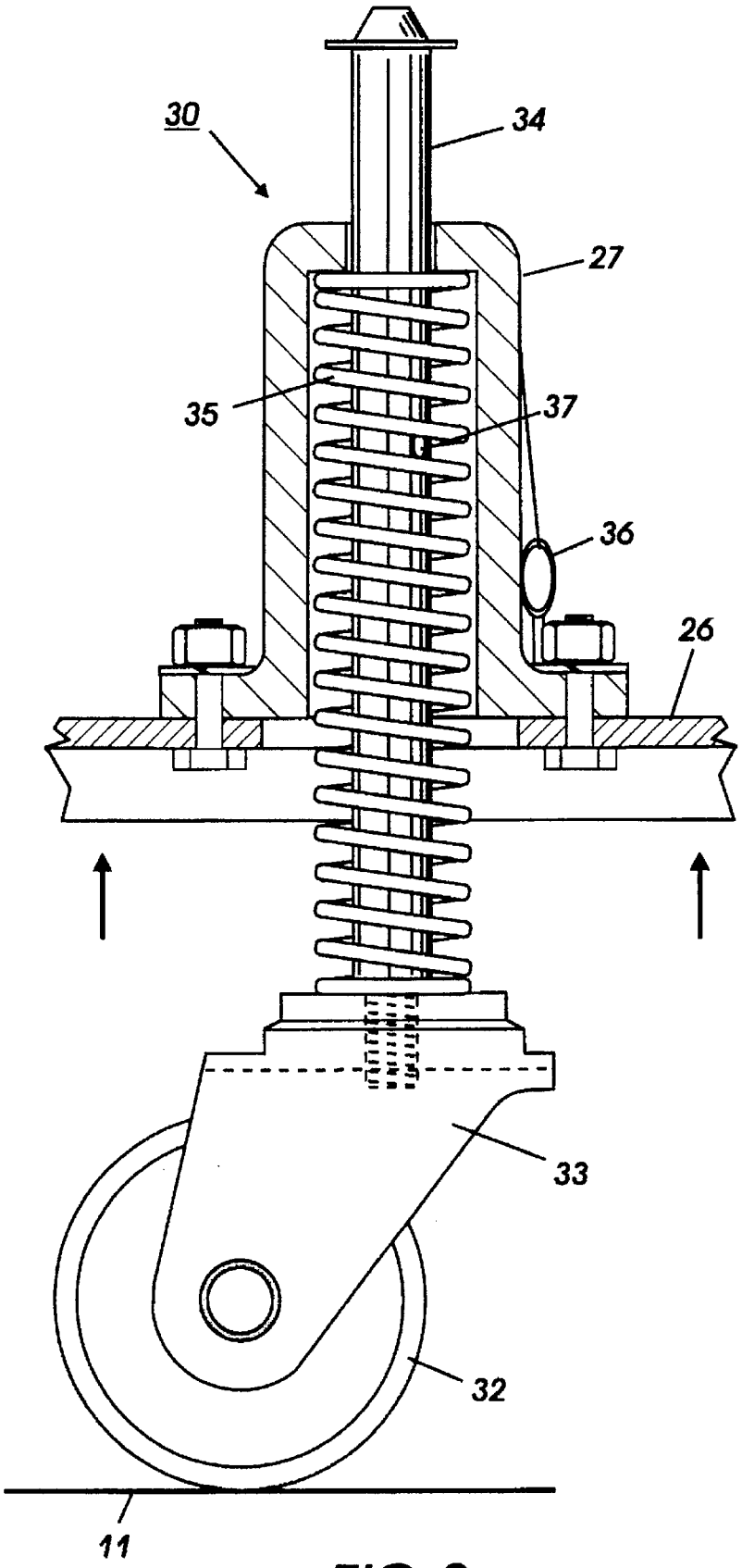
FIG. 3 is essentially the same view as FIG. 2 but showing the spring system released.
Figure 4:
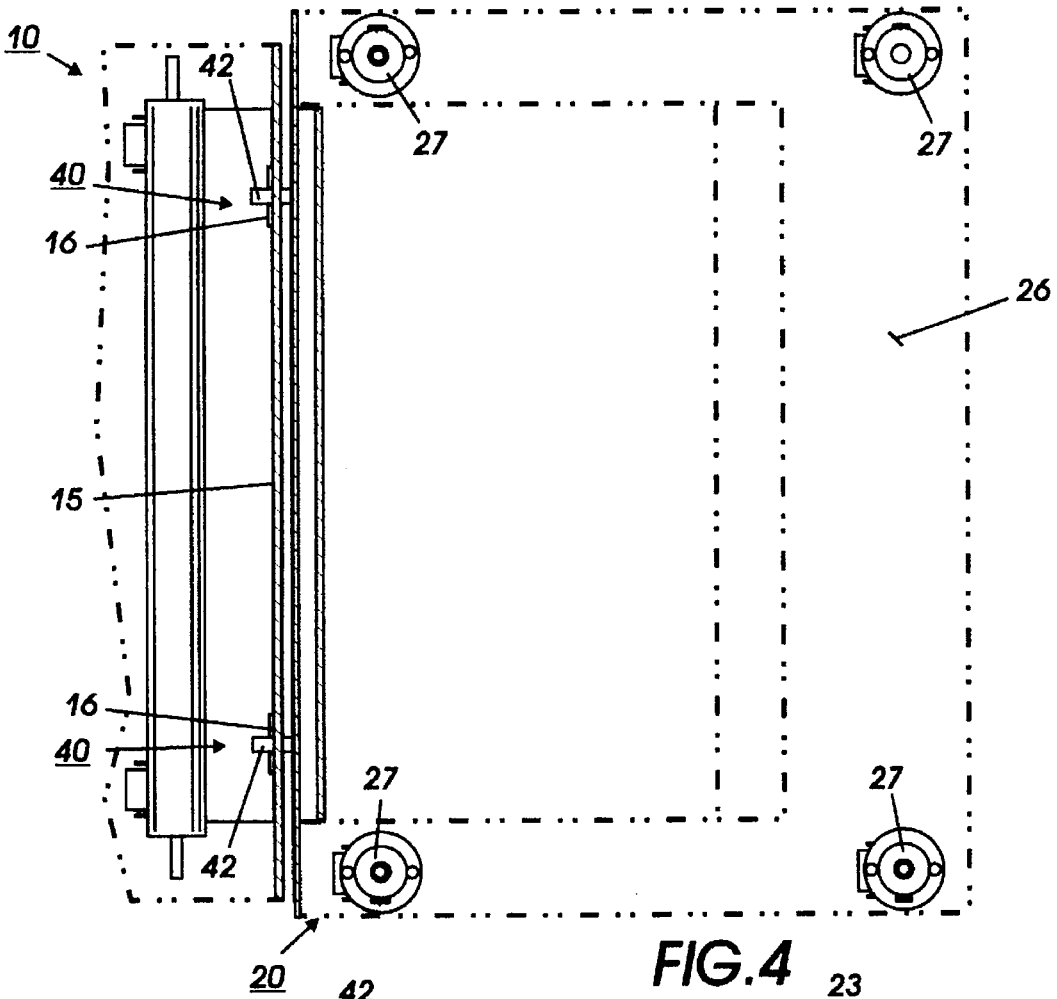
FIG. 4 is a partial top view taken along the lines indicated as FIG. 4 in FIG. 1.

Each of the sprung castor units 30 comprises a conventional wheel 32 and castor 33 arrangement providing for freely pivotable wheeling of the module 20 unit, and therefore free movement of the module 20 on any horizontal axis on all four wheels, as do the unsprung module castor units 50. However, in the sprung castor units 30, the castor wheel assembly is mounted on an elongated vertical shaft 34 surrounded by an elongated coil spring 35, as best illustrated in FIGS. 2 and 3. As shown in FIG. 2, for transporting and movement of the module 20 prior to its locking or latching to the reproduction apparatus 10, the spring 35 is held compressed by a retaining pin 36 such as a standard "hitch pin". This holds the spring 35 fully down, and holds the shaft 34 all of the way up, to essentially prevent any spring action and help maintain stability of the module 20 during such initial transport. The retaining pin 36 is removably secured in a pin hole 37 in the shaft 34.

Turning now to the module 20 latching or locking system, this is provided here by a mounting hook system 40 on the module 20, comprising a pair of upper hooks 42 designed to mate with and engage the pair of upper mounting apertures 16 in the reproduction apparatus 10, and a pair of lower hooks 44 designed to engage the pair of lower mounting apertures 17 in the reproduction apparatus 10, as will be described.

In either of the two embodiments described herein, the module may be freely wheeled into a docking position from either the front and/or the side of the reproduction apparatus 10 with the full weight of the module 20 being supported on the four castor wheels under the four corners of the module 20. The module 20 is riding at all times on the mounting base 26 to which these castor wheels are mounted through the mounting cups 27.

Once the module 20 is in position closely adjacent to the reproduction apparatus 10 at the side of the reproduction apparatus 10 in which the sheet output thereof is to feed sheets into the sheet input side of the module 20, the module 20 mounting hooks 42 and 44 are roughly laterally aligned with the apertures 16 and 17 in the end wall 15 of the reproduction apparatus 10. To this end, the horizontal spacing of the respective hooks and their apertures is substantially the same. However, in order to provide complete alignment and locking, it will be described below how to lift at least that side of the module containing the hooks 42 and 44 up above the bottom of the slots of said mounting apertures, and then to move the hooks downwardly slightly until the end of the hooks are on the inside of the end wall 15 below the bottom of the aperture slots, to positively engage the module 20 to the end wall 15, at least in the upper aperture 16. This is to provide positive "hang on" or "hook on" mounting of the module to the end wall of the reproduction apparatus 10.

Figure 5:
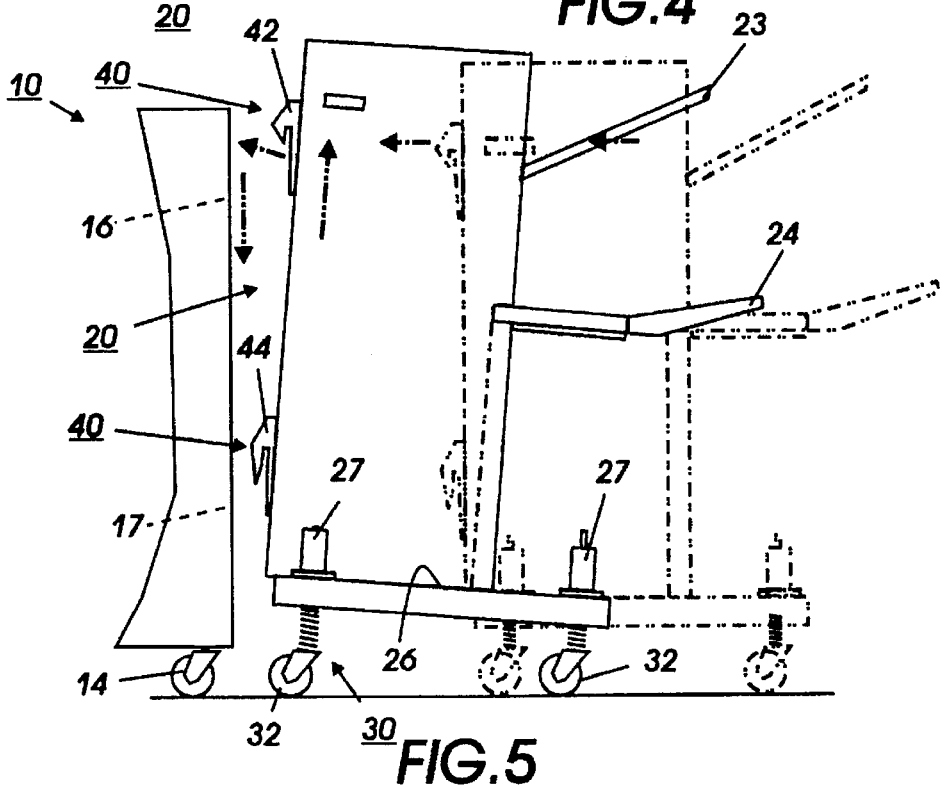
FIG. 5 is a schematic view of the embodiment of FIGS. 1–4 showing in respective phantom and solid views with movement arrows the docking and mounting movement of the exemplary module to the exemplary reproduction apparatus.

As indicated above, with the present system, it is not necessary, as it is in conventional "hang on" mounting systems, to lift the entire weight of the module 20. In fact, with the present system, only a small portion of the total weight of the module 20 need ever be lifted by the installer, and installation can be done easily by one person even if the module 20 is too heavy for a normal person to lift. Exemplary mounting movements or techniques are schematically illustrated for the two respective embodiments in FIG. 5 and FIG. 8. As may be seen in FIG. 5, by releasing all four retaining pins 36 for all four sprung castor units 30, the module 20 is now supported by the four springs 35. The spring force of the springs 35 is designed to have a total lifting force such that most, but not all, of the weight of the module 20 is supported thereon even when the module is lifted. The hooks 42 and 44 at this point are still slightly below the level needed for locking the hooks into the mounting apertures 16 and 17. Thus, as shown in FIG. 5 by the phantom positions and movement arrows, a slight manual lifting force, e.g., as little as from 9 to 20 pounds, can be applied to a handle or other grip point on the module on the front and/or back side of the module 20 while moving the module 20 against the reproduction apparatus 10. The spring factor of the springs 35 and their movement of the shaft 34 of the sprung castor unit 30 is such as to maintain most of the weight of the module on these castor units 30 while this docking movement is made by the operator. This allows the hooks to enter and mate with the mounting apertures. Then, the installer, by simply releasing the slight vertical force being applied, allows the module 20 to settle back down on its spring mounting until the base of the hooks engage the base of the mounting slots to securely latch the module 20 to the reproduction apparatus 10. Due to the preset positions of the mounting hooks and the apertures, that latching automatically fully aligns the sheet output of the reproduction apparatus with the sheet input of the module. By inserting the bottom hooks first, lateral alignment is confirmed and held while the top hooks are being inserted in the top apertures.

Figure 8:
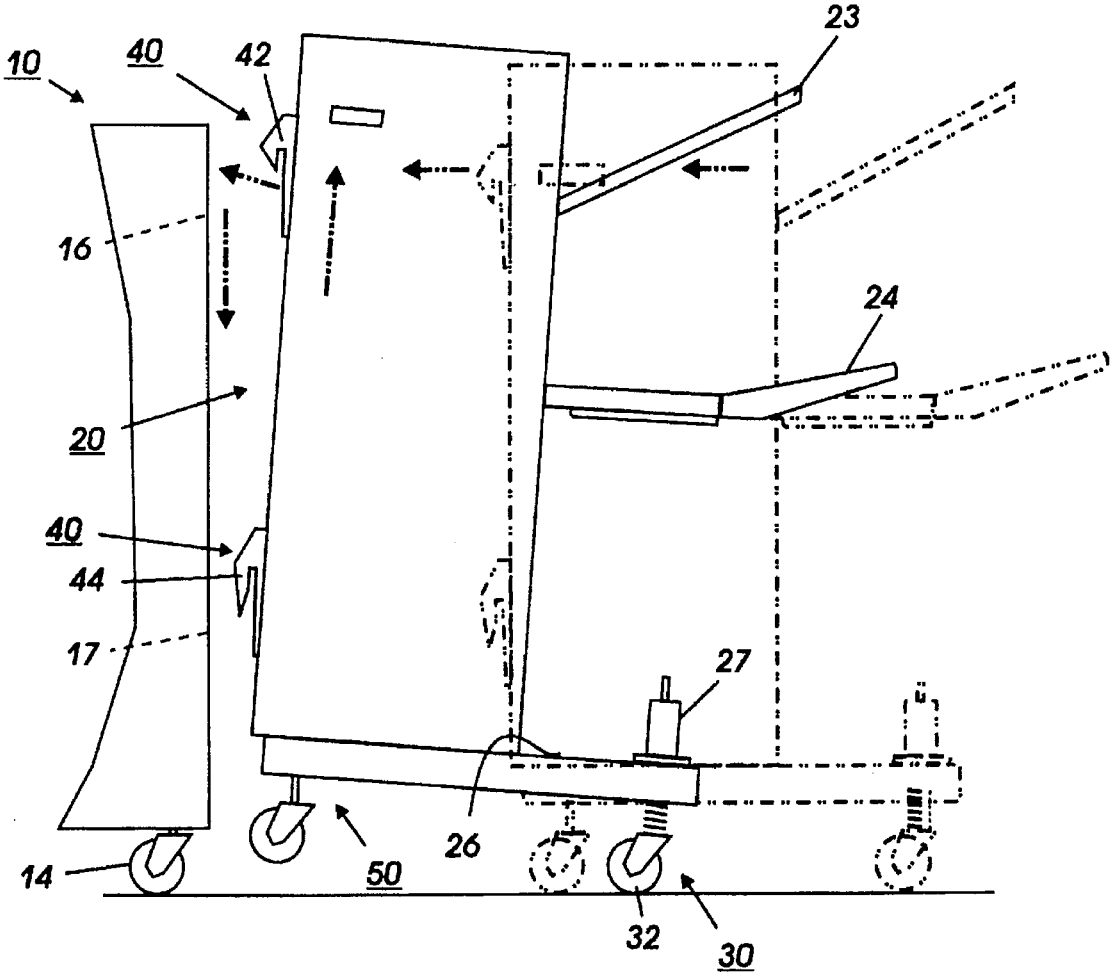
FIG. 8 is a view similar to FIG. 5 of the embodiment of FIGS. 6 and 7.

As shown in FIG. 8, the other embodiment only has spring mounted castor units under the outboard side of the module, the side away from the reproduction apparatus 10 and thus opposite from the side of the module 20 with the mounting hooks. In the mounting arrangement illustrated schematically in FIG. 8, the previously described mounting procedure may be varied by first, before removing the retaining pins 36, tilting on those outboard castors and moving forward the module 20 as otherwise described above, to lift the bottom hooks 44 enough to insert into the lower mounting apertures 17 with a slight vertical lifting and tilting force. Then, by releasing that manual force, the lower hooks 44 latch onto the lower mounting apertures 17. At that point, the hitch pins 36 may be removed from the outboard spring castor units 30. That automatically lifts and tilts forward the module slightly with the force of these springs 35. Then, by grasping the right or front side illustrated handle and lifting it with a slight manual force and pushing the top of the unit module forward with a slight force, the top hooks 40 (which are now already laterally aligned by the bottom hooks) are moved into the upper mounting apertures 16. Then, by releasing the lifting movement on the module 20, the module 20 automatically drops, with a small force, with the hooks sliding down over the bottom of the aperture slots to latch and lock the module unit 20 to the reproduction apparatus 10. If desired, an additional safety screw or other locking may be provided to prevent inadvertent unlatching of the unit by unauthorized tampering.

Note that in either of the two described mounting systems only a small portion of the weight of the module 20 is actually hanging on the end wall 15 of the reproduction apparatus 10 and that most of the weight is carried by the sprung and/or unsprung castor units under the module 20. Furthermore, this mounting and support arrangement is not substantially affected by differences in the floor level between the reproduction apparatus 10 in the module 20, as long as it is within the operating range of vertical movement of the springs 35 and shaft 34.

It will be appreciated that unlatching, dismounting and removal of the module 20 for repair or substitution may be done simply by reversing the above steps. That is, slightly lifting the module 20 and tilting it slightly away from the reproduction apparatus 10 to remove the mounting hooks from the mounting apertures, and then rolling the module away from the reproduction apparatus 10. For further movement, it is desirable to press down on the module 20 to compress the springs 35 and to put the retaining pins 36 back into the pin holes 37 in the shafts 34 to stabilize the unit for rolling it away on the wheels 32. This compression of the springs 35 can be done for the outboard springs while the lower hooks 44 are still retained in the lower mounting apertures 17 by tilting the unit downwardly at that point.

Various alternative shapes and dimensions for the hooks and mounting apertures may be provided. The exemplary mounting apertures shown particularly in FIG. 9 may be for example approximately 40 mm in vertical dimensions for the top apertures 16 and 54 mm for the lower mounting apertures 17. The particular hooks and apertures illustrated are of low cost and simple manufacture in sheet metal, but it will be appreciated that numerous other configurations may be used.

While the embodiments disclosed herein are preferred, it will be appreciated from this teaching that various alternatives, modifications, variations or improvements therein may be made by those skilled in the art, which are intended to be encompassed by the following claims:

We claim:

1. In a reproduction system for generating printed sheets with a reproduction apparatus and providing for docking and operatively connecting and disconnecting one or more selected paper handling modules of substantial weight to said reproduction apparatus, wherein said reproduction apparatus and said paper handling module have respective sheet feed openings, which respective sheet feed openings are operatively aligned for sheet feeding therebetween when a said selected paper handling module is operatively connected to said reproduction apparatus;

a system for said docking and removably operatively connecting and disconnecting a selected said paper handling module accessory unit to said reproduction apparatus with greatly reduced manual movement force irrespective of the weight of said module, including a locking system for positively securing said module to said reproduction apparatus in a locking position with said sheet feed opening of said module sufficiently operatively vertically aligned with said sheet feed opening of said reproduction apparatus for sheet feeding opening of said reproduction apparatus for sheet feeding therebetween, wherein said paper handling module accessory unit has a transporting system allowing said module to be freely manually movable in any horizontal direction for both frontal and lateral horizontal movement relative to said reproduction apparatus into a docking position therewith while supporting the weight of said module, said paper handling module accessory unit has a low-force vertical docking position adjustment system providing for low force manual vertical movement of said module relative to said reproduction apparatus from said docking position into said locking position, after said module is initially horizontally docked with said reproduction apparatus, and said vertical docking position adjustment system includes a weight supporting system for automatically supporting a major portion of the weight of said module in said manual vertical movement of said module into said locking position, for said greatly reduced manual movement force.

2. The system of claim 1, wherein said vertical docking position adjustment system and its said weight supporting system comprises a spring loaded vertically movable separation system between said module transporting system and said module.

3. The system of claim 1 wherein said module transporting system comprises plural castored wheels mounted under said module, and wherein said vertical docking position adjustment system and its said weight supporting system comprises a vertically movable wheel mounting system with module weight supporting springs vertically acting to provide low force vertical movement of said module relative to said castored wheels.

4. The system of claim 1, wherein said locking system for securing said module to said reproduction apparatus in said locking position is latched by first vertically lifting said module slightly above said initial docking position, with said weight lifting system and a small added manual vertical force, and moving said module against said reproduction apparatus, and then releasing said small manual vertical force to allow said module to drop into said locking position and latch.

5. The system of claim 1, wherein said locking system for securing said module to said reproduction apparatus in said locking position comprises mounting hooks and hook retainers positioned so that when said module is vertically lifted slightly above said initial docking and said locking position said mounting hooks may be inserted into said hook retainers, and so that said mounting hooks latch said module to said reproduction apparatus on said hook retainers by automatic downward movement of said module when said module is released.

6. The system of claim 1 wherein said weight supporting system automatically lifts all but a minor portion of the weight of said module in said vertical movement of said module into said locking position.

7. The system of claim 1 wherein said paper handling module is a finishing unit for binding and stacking sets of printed sheets from said reproduction apparatus.

8. The system of claim 1, wherein said module transporting system comprises plural castored wheels mounted under said module, and wherein said vertical docking position adjustment system weight supporting system provides low force vertical movement of said module relative to said castored wheels with module weight supporting springs which are spring mounting at least one side of said module relative to said castored wheels.

9. The system of claim 8 wherein a removable spring locking system normally removably locks said module weight supporting springs.

10. An improved method for manually removably locking a paper handling module to a reproduction apparatus in a locking position, wherein said reproduction apparatus and said paper handling module have respective sheet feed openings, which respective sheet feed openings are operatively aligned for sheet feeding therebetween when said module is so locked to said reproduction apparatus in said locking position, and wherein said paper handling module has a weight which is undesirable for manual lifting into said locking position; comprising an improved system for said locking of said module to said reproduction apparatus with greatly reduced manual force, by:

suppoding said module on an integral module transporting system on which said module is freely movable in any horizontal direction relative to said reproduction apparatus;

moving said module on said module transporting system into an initial docking position closely adjacent to said reproduction apparatus while supporting the weight of said module on said transporting system, then slightly vertically lifting at least one side of said module with only a small vertical manual lifting force applied to said module while most of the weight of said module is lifted with an automatic weight lifting system;

moving said module towards said locking position with said reproduction apparatus while so lifting said module;

and then removing said small vertical manual lifting force from said module, to lock said module to said reproduction apparatus with said respective sheet feed openings operatively aligned for sheet feeding therebetween.

11. The method of claim 10 wherein said automatic weight lifting is provided by vertically spring loading at least one side of said module on said module transporting system with a spring loading system that supports all but a minor portion of the weight of said module throughout said slight vertical lifting of said module with said small vertical manual lifting force.

12. The method of claim 10 wherein said module automatically drops slightly into said locking position when said small vertical manual lifting force is removed, to automatically latch said module to said reproduction apparatus.

13. The method of claim 12 wherein said module is hooked onto said reproduction apparatus in said locking position by hooking mounting hooks on said module onto hook retainers in said reproduction apparatus.

14. The method of claim 11 wherein said module is so movable on plural castored wheels mounted under said module providing said module transporting system.

15. The method of claim 10 wherein said module is unlocked from said reproduction apparatus with only a small manual force much less than said weight of said module by reversing the above steps.

16. The method of claim 10 wherein said module is initially tilted away from said reproduction apparatus on said module transporting system in said initial docking position and moved towards said reproduction apparatus before said step of slightly vertically lifting said module.

17. The method of claim 16 wherein a pair of lower hooks on said module are engaged in lower hook retainers on said reproduction apparatus in said initial tilting step, and then a pair of upper hooks on said reproduction apparatus are engaged in upper hook retainers in a second tilting step in coordination with said slight vertical lifting step.

* * * * *